United States Patent [19]

Hildebrandt

[11] 4,372,254

[45] Feb. 8, 1983

[54] HYDRAULIC HEAT GENERATOR

[76] Inventor: Edmund Hildebrandt, 6 Cedar St., Clinton, Mass. 01510

[21] Appl. No.: 227,626

[22] Filed: Jan. 23, 1981

[51] Int. Cl.[3] ..... F22B 3/06

[52] U.S. Cl. ..... 122/26; 126/247

[58] Field of Search ..... 122/26; 126/247; 237/1 R

[56] References Cited

U.S. PATENT DOCUMENTS

| | | | |
|---|---|---|---|
| 2,991,764 | 7/1961 | French | 122/26 |
| 3,813,036 | 5/1974 | Lutz | 122/26 X |
| 4,277,020 | 7/1981 | Grenier | 122/26 X |
| 4,312,322 | 1/1982 | Freihage | 122/26 X |

FOREIGN PATENT DOCUMENTS

| | | | |
|---|---|---|---|
| 371529 | 3/1923 | Fed. Rep. of Germany | 122/26 |

*Primary Examiner*—Edward G. Favors

*Attorney, Agent, or Firm*—Charles R. Fay

[57] ABSTRACT

A hydraulic heat generator including a reservoir, a pump, a heating area and a medium giving off heat at a remote location wherein the heating element includes a relatively zigzag, very thin passage for the hydraulic material received from the reservoir and including thermostatically controlled means for varying the thickness of this path when called upon to do so, depending upon the setting thereof.

15 Claims, 5 Drawing Figures

HYDRAULIC HEAT GENERATOR

BACKGROUND OF THE INVENTION

This is an energy related invention and it is recognized that there have been schemes provided in the past for attempting to derive useful heat by use of a motor, a pump and a hydraulic medium which is treated in a way to increase the heat thereof. One example of this is the provision of a pair of tubs, one slightly spaced within the other, with oil between the two. A means is provided to rotate one of the tubs relative to the other tending to heat the oil and provide heat simply through the use of electric power, for the general purpose of saving fossil fuel. These schemes have not turned out to be practical, or efficient. As the oil heats, it thins and becomes less viscous so that the heating action of the rotating tub is lessened. It is the general purpose of the present invention to provide a new and improved hydraulic heat generator which is not only useful but is efficient in operation, the efficiency being generally maintained.

SUMMARY OF THE INVENTION

In the present case, a reservoir for the hydraulic material, such as oil or the like, is provided to be pumped to a heating element, through the heating element and to a source of heat at a preferably remote location. The invention resides mainly in the structure of the heating element which comprises in general a series of pipes or tubes located in more or less continuous side by side relation whereby the hydraulic material is fed through a long path but which path occupies a relatively short area, saving space. The pipes or tubes are preferably square or rectangular and are provided interiorly thereof with a series of fixed spaced tapered fingers similar to a comb. A second and opposed comb-like element is provided, and it has fingers or teeth lying between the fingers or teeth of the first mentioned comb-like element, all of the fingers or teeth being relatively tapered, being broader at their bases than at their terminal ends. This provides a zig-zag narrow path for the hydraulic fluid through the tube.

Means is provided for moving the second series of fingers or teeth in or out relative to the first series of fingers or teeth, which action will be seen to cause a variation in size as to the spaces between the two sets of fingers or teeth. These spaces are continuous throught the pipe or tube and constitute the path for the hydraulic medium, and the adjustment thereof as stated above varies the thickness of the path for the hydraulic fluid.

At start up, the oil will be relatively viscous, but as it procedes through the zigzag path described and starts to heat, it will tend to thin out and lose heating efficiency. A thermostatically controlled restriction regulator is provided to move the movable fingers or teeth in or out relative to the fixed fingers or teeth to achieve a degree of narrowing the path for the fluid as may be decided upon to be the most efficient according to the heat and viscosity encountered. The movable teeth are mounted on a single element and it has a tapered edge or surface which corresponds to a complementarily tapered edge on the regulator itself, which in turn rectilinearly moved by the thermostatically controlled restriction regulator when called upon to do so by the setting thereof.

It is preferred that the fingers or teeth be striated, grooved, or ribbed in any desired kind of pattern, because this increases turbulence and the heat produced.

PREFERRED EMBODIMENT OF THE INVENTION

Figure 1:
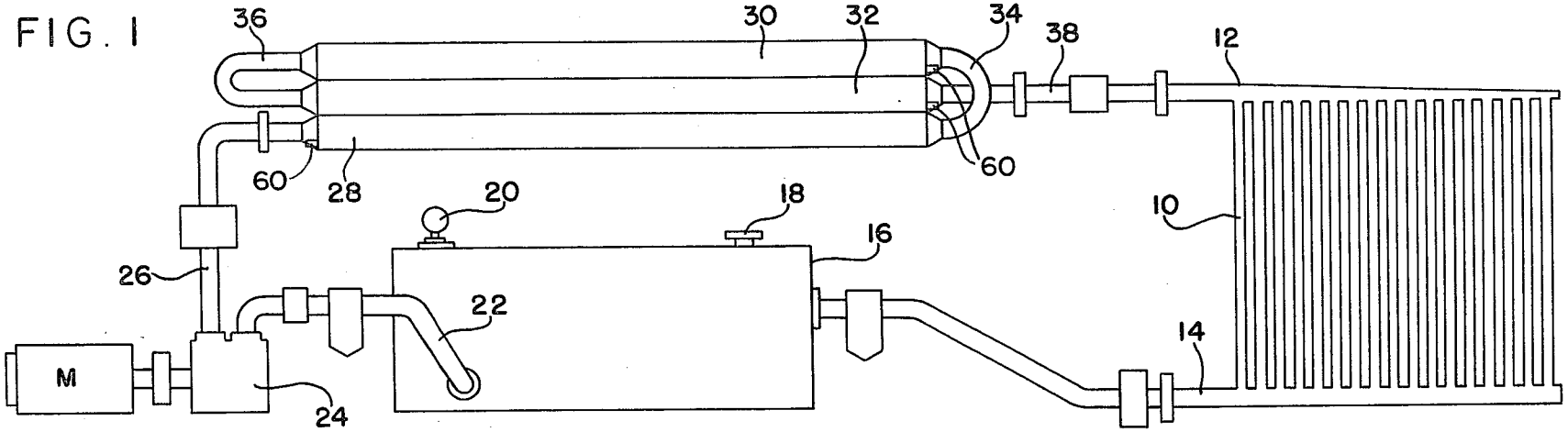
FIG. 1 is a layout illustrating the entire system.
Figure 3:
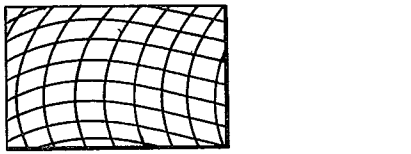
FIGS. 3, 4 and 5 show suggested striated patterns which may be used on the fingers or teeth.
Figure 4:
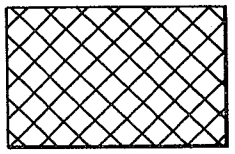
Figure 5:
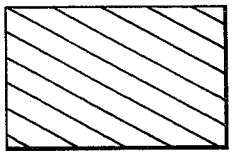

Refer to FIG. 1, the area where the useful heat to be used is indicated at 10. This is shown here more or less as a radiator or grill type of heat diffuser, but of course, it can be any kind of known heater. It has an inlet at 12 for the heated material and an outlet at 14 for the cooler hydraulic medium. Suitable relief valves, filters, etc. can be utilized in this line but in any event the hydraulic medium is returned to a reservoir of suitable type 16, which may have a filter 18 and temperature gauge 20 and other apertenances that may be required. A line 22 leads through a filter and check valve to a pump 24 driven by motor M through an outlet 26 and reducing valve to the first sectional pipe or tube which is indicated at 28.

While there may be a single pipe 28 it is preferred that this be extended by connecting to another like pipe or tube 30 and in some cases to even a third at 32 and more if found required or convenient. The pipes or tubes are connected variously as by pipes 34, 36 and the like and there is an outlet 38 leading to a check valve into the feed line for tube 28.

Figure 2:
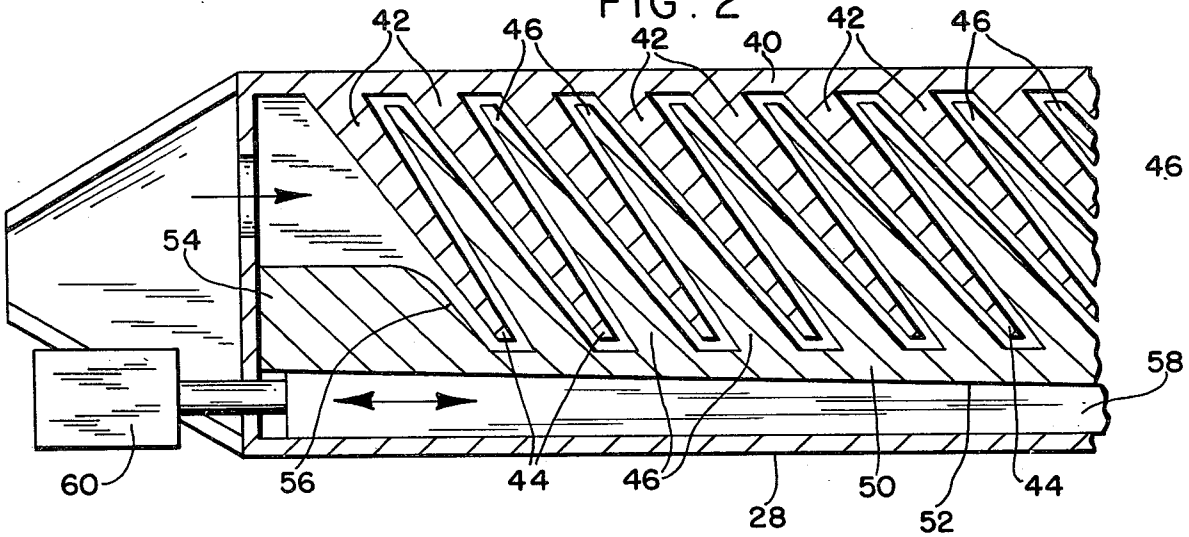
FIG. 2 is an enlarged sectional view illustrating the inside construction of the interfitting fixed and movable fingers or teeth.

FIG. 2 illustrates the means for producing the heat. This Figure is a cross section of any of the tubes 28, 32, 30 etc. These tubes are preferably square or rectangular. On one wall 40 of the tube, i.e. 28, there is a series of fixed spaced fingers 42,42 on the down-stream slant shown and which taper from relatively large bases to relatively narrow terminal end portions 44. These fingers are fixed and may be hollow and made of any suitable materials such as tool steel, stainless steel, etc. It will be seen that these fingers are in a kind of comb-like form in which the teeth are slanted one way and taper down from the back of the comb, i.e. 40.

Between each of fixed teeth or fingers 42, there are teeth or fingers 46 complementary to the teeth or fingers 42. These fingers are fixed to each other in a comb form, but this comb is not fixed to the tube. They are all mounted on a single support 50 which has a tapered edge 52 at one side thereof. These teeth or fingers 46 may be either hollow or solid and made of any suitable meterials as are the other complementary fingers and at one end of support 50 there is a wedge 54, having an edge 56 so that when the entire assembly of fingers 56 and support 50 is moved, it has to move in the direction of slant of the fingers 46, and being spaced therefrom in all areas will become closer (or more spaced) according to the directional motion of the assembly 46, 50. This varies the width (thickness) of the zigzag path for the fluid.

This motion is controlled by a slanting wedge 58 connected to a member 60 which may be, for instance, a piston or cylinder hydraulically controlled, or worm gear, etc. electrically controlled by a thermostat so as to move the wedge or cam 58 in the required direction according to the heat of the hydraulic material which tends to thin out after start-up of the operation. When the path is lessened, the heating effect of the hydraulic medium being forced through the zigzag path is increased.

It is preferred that the faces of the fingers or teeth be striated, grooved or made with projections like a wood rasp or the like in order to increase the resistance to flow and the turbulence in the hydraulic medium so as to increase the heating effect thereof.

I claim:

1. A hydraulic heat generator comprising a source of hydraulic fluid, a pump therefor, a heating element, and a heat diffusing means, and means placing the source, pump, element and means in circuit, said heating element including an elongated generally hollow member and a pair of sets of relatively fixed generally complementary interfitting free-ended, opposed finger-like members therein, said sets of finger-like members together defining a zig-zag path for the hydraulic fluid through the heating element, said pump acting to pump the fluid under pressure through the entire path.

2. The hydraulic heat generator of claim 1 including means to vary the thickness of the path.

3. The hydraulic heat generator of claim 2 wherein the last named means includes means to vary the degree of relative penetration of the opposed sets of finger-like members.

4. The hydraulic heat generator of claim 1 including a fixed support for one set of finger-like members and a movable support for the finger-like members of the opposed set.

5. The hydraulic heat generator of claim 4 including a thermostatically controlled means for moving the movable support.

6. The hydraulic heat generator of claim 5 wherein the movable support includes a tapered edge and the thermostatically controlled means includes a complementary and contiguous tapered edge.

7. The hydraulic heat generator of claim 1 wherein the finger-like members have surfaces forming the path for the hydraulic fluid, said surfaces, at least in part, being roughened to increase resistance to the flow of hydraulic fluid.

8. The hydraulic heat generator of claim 1 including at least one further heating element connected to the first one in prolongation thereof and in parallel side-by-side relation thereto.

9. A hydraulic heat generator comprising a source of hydraulic fluid connected to a pump, a heating element, and a heat diffuser in a closed circuit, the heating element comprising an elongated hollow tube, one set of tapered spaced free-ended fingers mounted in fixed relation in the tube and extending from one side thereof toward the opposite side of said tube, said fingers tapering down from relatively wide bases to their free ends, a second set of tapered free-ended fingers alternating and interfitting with the fingers of the fixed set and being slightly spaced therefrom providing a narrow substantially zigzag path through the tube for the hydraulic fluid, movable means mounting the second set of fingers in fixed relation thereto, means engaging said movable means to move the same toward and away from the first set of fingers while still being in interfitting relation to vary the width of the path, and a thermostatically controlled member to actuate the means to move the movable means.

10. A hydraulic heat generator comprising a source of fluid, a heating element, and means to circulate fluid through the heating element, the heating element including means providing a narrow path through the heating element for the fluid, two sets of interfitting fingers forming the narrow path into a substantially zig-zag pattern, and the means to vary the width of the path including means to relatively advance or retract the interfitting fingers relative to each other.

11. The hydraulic heat generator of claim 10 wherein the fingers are tapered, one set having narrow ends adjacent to wider bases of the other set.

12. The hydraulic heat generator of claim 11 wherein the fingers are set at an angle to the length of the heating element, leaning down-stream.

13. A hydraulic heat generator comprising a source of hydraulic fluid, a pump therefor, a heating element, and a heat diffusing means, and means placing the source, pump, element and means in circuit, said heating element including an elongated generally hollow member and a pair of sets of generally complementary interfitting free-ended, opposed finger-like members therein, said sets of finger-like members together defining the path of the hydraulic fluid through the heating element, means to vary the width of the path including means to vary the degree of relative penetration of the opposed sets of finger-like members.

14. The hydraulic heat generator of claim 13 including a thermostatically controlled movable element, one set of finger-like members being mounted thereon.

15. The hydraulic heat generator of claim 13 wherein the finger-like members are tapered from their bases to their free-ends and being spaced to a greater degree adjacent the free-ends, the finger-like members oppositely, and each finger-like member of one set fitting the spaces of a pair of respective finger-like members of the opposed set.

* * * * *